US008049745B2

(12) United States Patent
Kim et al.

(10) Patent No.: US 8,049,745 B2
(45) Date of Patent: Nov. 1, 2011

(54) DISPLAY APPARATUS AND CONTROL METHOD THEREOF

(75) Inventors: Young-chan Kim, Uiwang-si (KR); Heung-jun Park, Anyang-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 749 days.

(21) Appl. No.: 11/469,962

(22) Filed: Sep. 5, 2006

(65) Prior Publication Data

US 2007/0064158 A1 Mar. 22, 2007

(30) Foreign Application Priority Data

Sep. 16, 2005 (KR) ..... 10-2005-0086727

(51) Int. Cl.
*G09G 5/00* (2006.01)

(52) U.S. Cl. ..... 345/213

(58) Field of Classification Search ..... 345/98, 345/213

See application file for complete search history.

(56) References Cited

U.S. PATENT DOCUMENTS

2001/0011980 A1* 8/2001 Jang ..... 345/87
2001/0020928 A1* 9/2001 Yanagisawa et al. ..... 345/98

FOREIGN PATENT DOCUMENTS

| | | |
|---|---|---|
| JP | 10-66259 | 3/1998 |
| JP | 2001-339852 | 12/2001 |
| KR | 1999-53561 | 7/1999 |
| KR | 2005-40499 | 5/2005 |
| WO | WO 2005/048230 | 5/2005 |

* cited by examiner

*Primary Examiner* — Amare Mengistu
*Assistant Examiner* — Randal Willis
(74) *Attorney, Agent, or Firm* — Stanzione & Kim, LLP

(57) ABSTRACT

A display apparatus including a display, a video processor to output an video signal to the display, a power supply to output a power signal to turn on/off the display, and a controller to control at least one of the power supply and the video processor to make a sequence difference between an enable/disable time of the video signal outputted form the video processor and an on/off time of the power signal outputted from the power supply be within a predetermined range. The display apparatus and a control method thereof, in which the sequence difference is adjusted to be within a predetermined range.

26 Claims, 4 Drawing Sheets

DISPLAY APPARATUS AND CONTROL METHOD THEREOF

CROSS-REFERENCE TO RELATED APPLICATIONS

This application claims the benefit of Korean Patent Application No. 2005-0086727, filed on Sep. 16, 2005, in the Korean Intellectual Property Office, which is hereby incorporated in its entirety and by reference.

BACKGROUND OF THE INVENTION

1. Field of the Invention

The present general inventive concept relates to a display apparatus and a control method thereof, and more particularly, to a display apparatus and a control method thereof to improve an on and/or off time for electric power supplied to a display.

2. Description of the Related Art

In general, a display apparatus receives a video signal of a display mode from a video signal source, such as a computer, a TV broadcasting system and etc., to display an image on a display. The display apparatus can use a flat panel such as a liquid crystal display (LCD) panel, a plasma display panel (PDP), etc. as well as a cathode ray tube (CRT) as the display.

In the display apparatus, the display receives electric power and processes the video signal to be displayed as the image thereon. Further, a time difference between a time of receiving the electric power and a time of displaying an image should not exceed a predetermined range.

In a conventional display apparatus, an internal circuit of a power supply supplying the electric power comprises a capacitor, so that the time difference between the time of receiving the electric power and the time of displaying the image is a predetermined time. Thus, in a case where the time difference between the time of supplying the electric power to the display and the time of displaying the image exceeds the predetermined range, noise is generated in the display or an excessive voltage is applied to the display.

SUMMARY OF THE INVENTION

The present general inventive concept provides a display apparatus and a control method thereof, in which a sequence difference, i.e., a time difference between an enable/disable time for a video signal to be applied to a display and an on/off time for a power signal to be applied to the display is adjusted to be within a predetermined range.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a display apparatus comprising a display, the display comprising a video processor to output an video signal to the display, a power supply to output a power signal to turn on/off the display, and a controller to control at least one of the power supply and the video processor to make a sequence difference between an enable/disable time of the video signal output from the video processor and an on/off time of the power signal output from the power supply be within a predetermined range.

The controller may change at least one of the on/off time of the power signal and the enable/disable time of the video signal when the sequence difference is not within the predetermined range.

The enable/disable time of the video signal may comprise at least one of the enable time of the video signal when the video signal starts to be displayed on the display and the disable time of the video signal when the video signal finishes being displayed on the display, and the on/off time of the power signal comprises at least one of an on time when an electric power starts to be supplied to the display and an off time when the electric power is blocked to the display.

The controller may delay the enable time of the video signal to adjust the sequence difference between the on time of the power signal and the enable time of the video signal, and delays the off time of the power signal to adjust the sequence difference between the off time of the power signal and the disable time of the video signal.

The controller may apply a power control signal having an initial on/off time to the power supply so as to control the on/off time of the power signal, determines a delayed time based on a time difference between the on/off time and the initial on/off time, and determines whether the sequence difference is out of the predetermined range according to whether the delayed time is not within a preset range.

The controller may output the power control signal having a changed initial on/off time to the power supply so as to control the on/off time of the power signal.

The display apparatus may further comprise a user selection unit, wherein when a delaying time to delay the on/off time of the power signal is input through the user selection unit, the controller delays at least one of the on/off time of the power signal and the enable/disable time of the video signal according to the delaying time.

The display apparatus may further comprise a delaying time store unit to store the delaying time, wherein the controller delays the on/off time of the power signal and the enable/disable time of the video signal according to the time period corresponding to the delaying time stored in the delaying time store unit.

The foregoing and/or other aspects and utilities of the present general inventive concept may also be achieved by providing a control method of a display apparatus having a display, the control method comprising outputting a power signal to turn on/off the display, outputting a video signal to the display, determining whether a sequence difference between an enable/disable time of the video signal and an on/off time of the power signal is within a predetermined range, and controlling the sequence difference to be within the predetermined range when the sequence difference is out of the predetermined range.

The controlling of the sequence difference to be within the predetermined range may comprise changing at least one of the on/off time of the power signal and the enable/disable time of the video signal.

The enable/disable time of the video signal may comprise at least one of the enable time of the video signal when the video signal starts to be displayed on the display and the disable time of the video signal when the video signal finishes being displayed on the display, and the on/off time of the power signal comprises at least one of an on time when an electric power starts to be supplied to the display and an off time when the electric power is blocked to the display.

The controlling of the sequence difference to be within the predetermined range may comprise delaying the enable time of the video signal to adjust the sequence difference between the on time of the power signal and the enable time of the video signal, and delaying the off time of the power signal to adjust the sequence difference between the off time of the power signal and the disable time of the video signal.

The determining of the sequence difference to be within the predetermined range may comprise applying a power control signal having an initial on/off time to the power supply so as to control the on/off time of the power signal, determining delayed time based on a time difference between the on/off time and the initial on/off time which are outputted from the power supply, and determining whether the sequence difference is out of the predetermined range according to whether the delayed time is out of a preset range.

The controlling of the sequence difference to be within the predetermined range may comprise outputting the power control signal having a changed initial on/off time, and changing the on/off time of the power signal by the power control signal.

The control method of the display apparatus further may comprise receiving a delaying time input signal to delay the on/off time of the power signal; and delaying at least one of the on/off time and the enable/disable time as much as a delaying time.

The delaying of the on/off time according to a time period corresponding to the delaying time may comprise storing the delaying time, and delaying at least one of the on/off time and the enable/disable time according to the time period corresponding to the stored delaying time.

The foregoing and/or other aspects and utilities of the present general inventive concept may also be achieved by providing a display apparatus, comprising a video source to supply a video signal to a display unit, a power source to provide a power signal to the display unit, and a controller to control at least one of an enable time of the video signal and an on time of the power signal so that the video signal is supplied to the display unit within a predetermined time after the power signal is provided to the display.

The foregoing and/or other aspects and utilities of the present general inventive concept may also be achieved by providing a display apparatus, comprising a display unit, a video processor to provide a video signal to the display unit, a power source to provide a power signal to the display unit, and a controller to relatively control enable and/or disable times of the video signal and on and/or off times of the power signal.

The foregoing and/or other aspects and utilities of the present general inventive concept may also be achieved by providing a display apparatus, comprising a display unit, a video process to provide a video signal to the display unit, a power source to provide a power signal to the display unit, and a controller to control the video processor and the power source to start to generate the video signal and the power signal according to a time difference.

The foregoing and/or other aspects and utilities of the present general inventive concept may also be achieved by providing a method of a display apparatus, the method comprising supplying a video signal to a display apparatus, providing a power signal to the display apparatus, and controlling at least one of an enable time of the video signal and an on time of the power signal so that the video signal is provided to the display unit within a predetermined time after the power signal is provided to the display.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
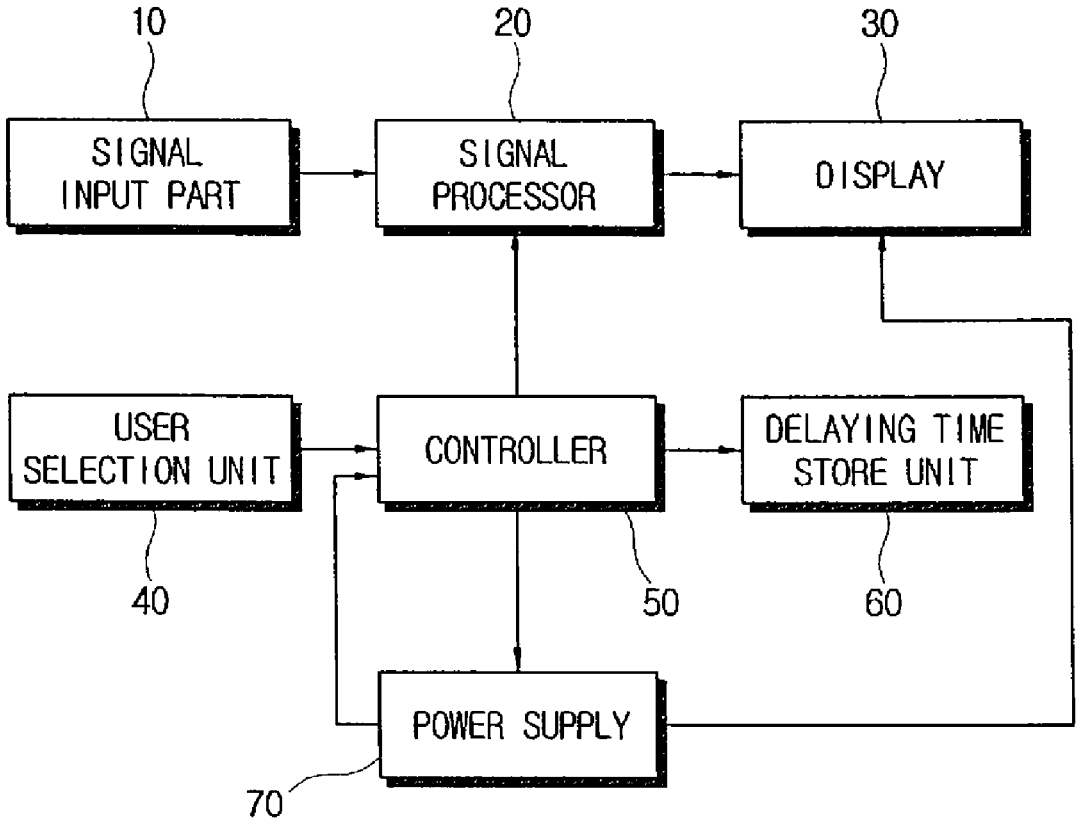
FIG. 1 is a control block diagram illustrating a display apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

FIG. 1 is a control block diagram illustrating a display apparatus according to an embodiment of the present general inventive concept. Referring to FIG. 1, the display apparatus comprises a display 30, a signal input unit 10, a signal processor 20 to process a video signal input through the signal input unit 10, a power supply 70 to supply electric power to the display 30, and a controller 50 to control the signal input unit 10, the signal processor 20, and the display 30.

The signal input unit 10 may comprise terminals corresponding to various formats of video signals. For example, the signal input unit 10 may comprise a composite input terminal (not shown) to receive a composite signal, an S-video input terminal (not shown) to receive an S-video signal, a component input terminal (not shown) to receive a component signal, a PC input terminal (not shown) to receive a PC signal, and a TV input terminal (not shown) to receive a TV signal.

The signal processor 20 processes the video signal that is input through the signal input unit 10 to be displayed on the display 30. The signal processor 20 outputs a processed video signal to the display 30.

The signal processor 20 may comprise various configurations according to the type of the display 30. For example, if the display 30 is an LCD, a PDP or a digital light processing (DLP), the signal processor 20 comprises a scaler (not shown) to scale a digital video signal to correspond to the processed video signal. If the display 30 is a CRT, the signal processor 20 comprises an amplifier (not shown) to amplify the video signal, and vertical and horizontal deflectors (not shown) which deflect an electron beam based on a vertical synchronizing signal and a horizontal synchronizing signal of the video signal.

Further, the signal processor 20 may comprise a video decoder (not shown), an A/D converter (not shown) and a tuner (not shown) so as to convert the various formats of the video signals that are input through the signal input unit 10 into a signal adapted for the scaler. Thus, the scaler can process the video signals having various formats.

The video decoder decodes the composite signal and the S-video signal that is input through the composite input terminal and the S-video input terminal, respectively, and outputs decoded signals to the scaler. The A/D converter converts the component signal and the PC signal which are input through the component input terminal and the PC input terminal, respectively, into digital signals, and outputs the digital signals to the scaler. The tuner selects and amplifies the TV signal input through the TV input terminal, and outputs the TV signal to the A/D converter. The video decoder and the A/D converter selectively process one of the video signals that are input through respective corresponding input terminals and output the video signal to the scaler by the controller 50.

The display 30 receives the signals processed by the signal processor 20 and displays a predetermined image. The display 30 comprises a display module (not shown) where the images are displayed, and a module driving part (not shown) to process the signals from the signal processor 20 to be displayed on the display module. The display module may comprise a CRT, a DLP, an LCD, a PDP, etc.

In the case of the DLP module, the module driving part may comprise an optical engine. In case of the LCD module, the module driving part may comprise a printed circuit board (PCB) to convert the signals input from the signal processor 20 into a gate signal and a data signal. Thus, the display 30 may comprise a module driving part corresponding to the display module type.

The power supply 70 supplies electric power to the display 30. The power supply 70 can output a power signal having a predetermined level to the display 30 according to a power control signal of the controller 50.

The controller 50 controls the signal processor 20 to output the video signal to the display 30. The controller 50 controls the signal processor 20 to adjust an enable/disable time for the video signal. The enable/disable time of the video signal comprises at least one of an enable time when the video signal is enabled and a disable time when the video signal is disabled. The enable time may comprise at least one of when the video signal starts to be transferred to the display 30 and when the video signal is enabled to be displayed on the display 30. The disable time may comprise at least one of when the transfer of the video signal to the display 30 stops and when the video signal is disabled to not be displayed on the display 30.

The controller 50 controls the power supply 70 to output the power signal to turn on/off the display 30. The controller 50 outputs the power control signal to the power supply 70 to adjust an on/off time for the power signal. The on/off time comprises at least one of an on time when the power signal is on and an off time when the power signal is off.

When the controller 50 determines whether at least one of a first sequence difference, i.e., a time difference between the on time of the power signal and the enable time of the video signal, and a second sequence difference, i.e., a time difference between the off time of the power signal and the disable time of the video signal is out of a predetermined range, the controller 50 can control each of the first sequence difference and the second sequence difference to be within the predetermined range. When the time difference is within the predetermined range, the time difference may be larger or smaller than a predetermined reference time by a predetermined limit. The first and second sequence differences may also be within first and second predetermined ranges, respectively The first and second predetermined ranges may be different from each other depending on start up and shut down characteristics of the display apparatus.

To adjust the first and second sequence differences, the controller 50 may change at least one of the on/off time for the power signal output from the power supply 70 and the enable/disable time for the video signal output from the signal processor 20. Thus, the controller 50 can control the power supply 70 to change the on/off times or the signal processor 20 to change the enable/disable times if at least one of the first and second sequence differences are out of the predetermined range. The controller 50 outputs the power control signal to the power supply 70 to output the power signal having a predetermined on/off time. The predetermined on/off time for the power control signal to control the on/off time is called an initial on/off time.

When the power supply 70 receives the power control signal having the initial on/off time, the power supply 70 outputs the power signal at an on/off time. The on/off time is obtained by delaying the initial on/off time by a predetermined time through a capacitor, or the like, internally provided in the power supply 70, to the display 30. On the other hand, the enable/disable times of the video signal are may not be delayed in the signal processor 20.

Therefore, the controller 50 can determine a delayed time difference based on the time difference between the on/off times of a feedback power signal output from the power supply 70 and the initial on/off time of the power control signal. The feedback power signal can be output when the power supply 70 starts supplying power to the display 30. Then, the controller 50 can determine whether the first and second sequence differences are out of a predetermined range according to the delayed time difference which is out of a preset range. The controller 50 may initialize the power control signal to control the power signal before the controller 50 determines the delayed time difference. The controller 50 then compares the initial on/off time of the power control signal with the on/off times of the feedback power signal to determine the delayed time difference.

The controller 50 can determine the on/off times of the power supply 70 on the basis of the feedback power signal from the power supply 70. The controller 50 can directly compare the on/off times of the feedback power signal with the enable/disable times of the video signal.

Therefore, based on the delayed time difference, the controller 50 changes the initial on/off time of the power control signal to control the on/off times of the power signal and outputs a changed power control signal to the power supply 70.

Meanwhile, the display apparatus may further comprise a user selection unit 40. The user selection unit 40 may be variously implemented by an input key, a button, etc., so that a user inputs or selects a desired function. The display apparatus can receive information about a delaying time through the user selection unit 40 so as to control the on/off times of the power signal. The user selection unit 40 can provide a predetermined delaying time input signal to the controller 50. The controller 50 can then determine the delaying time value from the predetermined delaying time input signal.

The controller 50 may delay the on/off times of the power signal according to the time period corresponding to the delaying time when the delaying time is input through the user selection unit 40. The controller 50 stores the input delaying time in a delaying time store unit 60 and delays the on/off times of the power signal based on the input delaying time.

That is, when the controller 50 receives the input delaying time through the user selection unit 40 while outputting the power control signal having the predetermined initial on/off time, the controller 50 may provide a second power control signal having a second initial on/off time delayed according to the time period corresponding to the delaying time to the power supply 70. The input delaying time input through the user selection unit 40 can be input when the display apparatus is manufactured or when a serviceperson determines whether the sequence difference is within the predetermined range. Alternatively, an ordinary user may input the delaying time.

In a case that the on/off times do not correspond to the initial on/off time, the controller 50 calculates the initial on/off time to delay the on/off times of the power signal according to the time period corresponding to the delaying time, and inputs a power control signal having the initial on/off time delayed as much as the calculated time to the power supply 70.

A part of a program statement of the controller 50 to control the on/off time of the power signal according to an exemplary embodiment of the present general inventive concept is shown below.

```
void LcdOn(void)
{
    SetBit(P2, PANEL_POWER);        // Panel On
    DelayMs(ON_DELAY + ondelay + user_on_delay );
    chr_reg1 = ReadScaler(OCTRL3);    // LVDS enable
    chr_reg1 |= 0x01;
    WriteScaler(OCTRL3, chr_reg1);
    chr_reg1 = ReadScaler(PLLCTRL1);    // data enable
    chr_reg1 &= (~0x01);
    WriteScaler(PLLCTRL1, chr_reg1);
}
  void LcdOff(void)
  {
      chr_reg1 = ReadScaler(OCTRL3);    // LVDS disable
      chr_reg1 &= (~0x01);
      WriteScaler(OCTRL3, chr_reg1);
      chr_reg1 = ReadScaler(PLLCTRL1);    // data disable
      chr_reg1 |= (0x01);
      WriteScaler(PLLCTRL1, chr_reg1);
      DelayMs(OFF_DELAY - offdelay + user_off_delay);
      ClrBit(P2, PANEL_POWER);    // Panel Off
  ,}
```

As shown in the program statement, the display apparatus supplies the electric power to the display 30 (Panel On) and enables an LVDS signal (LVDS enable) after the predetermined time. Then, the display 30 starts to communicate with the respective units and data are enabled (data enable), so that the video signal is applied to the display 30. Thus, when the delaying time elapses after the electric power is supplied to the display 30, the controller 50 outputs the video signal to the display 30. At this point, 'ON_DELAY' is an invariable value, and 'ondelay' is a value capable of delaying the initial on time of the power control signal according to the determined first sequence difference between the on time of the power signal and the enable time of the video signal on the basis of the feedback of the power signal output from the power supply 70.

Moreover, 'user_on_delay' is a value input through the user selection unit 40 and is used as, for example, the input delay time, to control the first sequence difference.

Meanwhile, to turn off the display 30, the display apparatus disables the LVDS signal (LVDS disable). Then, the display apparatus disables the data applied from the signal processor 20 (data disable), and then stops the electric power from being supplied to the display 30 (Panel Off). Thus, when the delaying time elapses after the video signal is disabled, the controller 50 turns off the display 30. Here, 'OFF_DELAY' is an invariable value and 'offdelay' is a value capable of delaying the initial off time of the power control signal according to the determined second sequence difference between the off time of the power signal and the disable time of the video signal on the basis of the feedback of the power signal outputted from the power supply 70.

Furthermore, 'user_off_delay' is a value input through the user selection unit 40 and is used to control the second sequence difference.

Figure 2A:
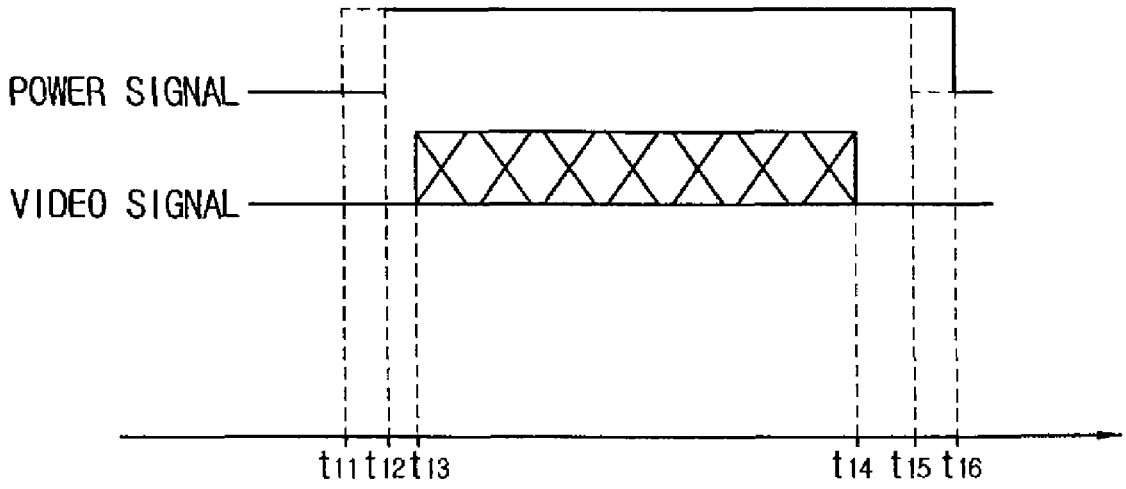
FIGS. 2A and 2B are timing diagrams illustrating a power signal and a video signal according to an embodiment of the present general inventive concept.

FIG. 2A is a timing diagram illustrating the power signal and the video signal before the sequence differences are not compensated in the present general inventive concept. Referring to FIG. 2A, the video signal is enabled at 't13' and disabled at 't14'. That is, the enable time of the video signal is 't13', and the disable time of the video signal is 't14'. When the power supply 70 is controlled by the power control signal to supply the electric power to the display 30 at 't11' and block the electric power at 't15', the power supply 70 substantially outputs an on power signal at 't12' to supply the electric power to the display 30 and an off power signal at 't16' to block the electric power. That is, the initial on time of the power control signal is 't11', the on time of the power signal is 't12', the initial off time of the power control signal is 't15', and the off time of the power signal is 't16'.

Figure 2B:
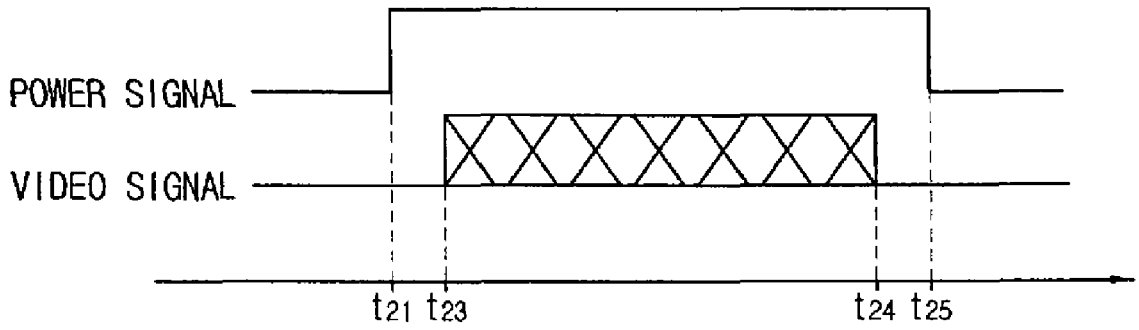

FIG. 2B is a timing diagram illustrating the power signal and the video signal where the sequence differences are compensated for in the present general inventive concept. That is, when the controller 50 adjusts the sequence difference, i.e., compensates the sequence differences to be within the predetermined range, the timing diagram of the power signal and the video signal appears as illustrated in FIG. 2B.

Referring to FIG. 2B, the power supply 70 is controlled by the power control signal to supply the electric power to the display 30 and the on time of the power signal is 't21', the enable time of the video signal is 't23', the off time of the power signal is 't25', and the disable time of the video signal is 't24'.

Figure 3:
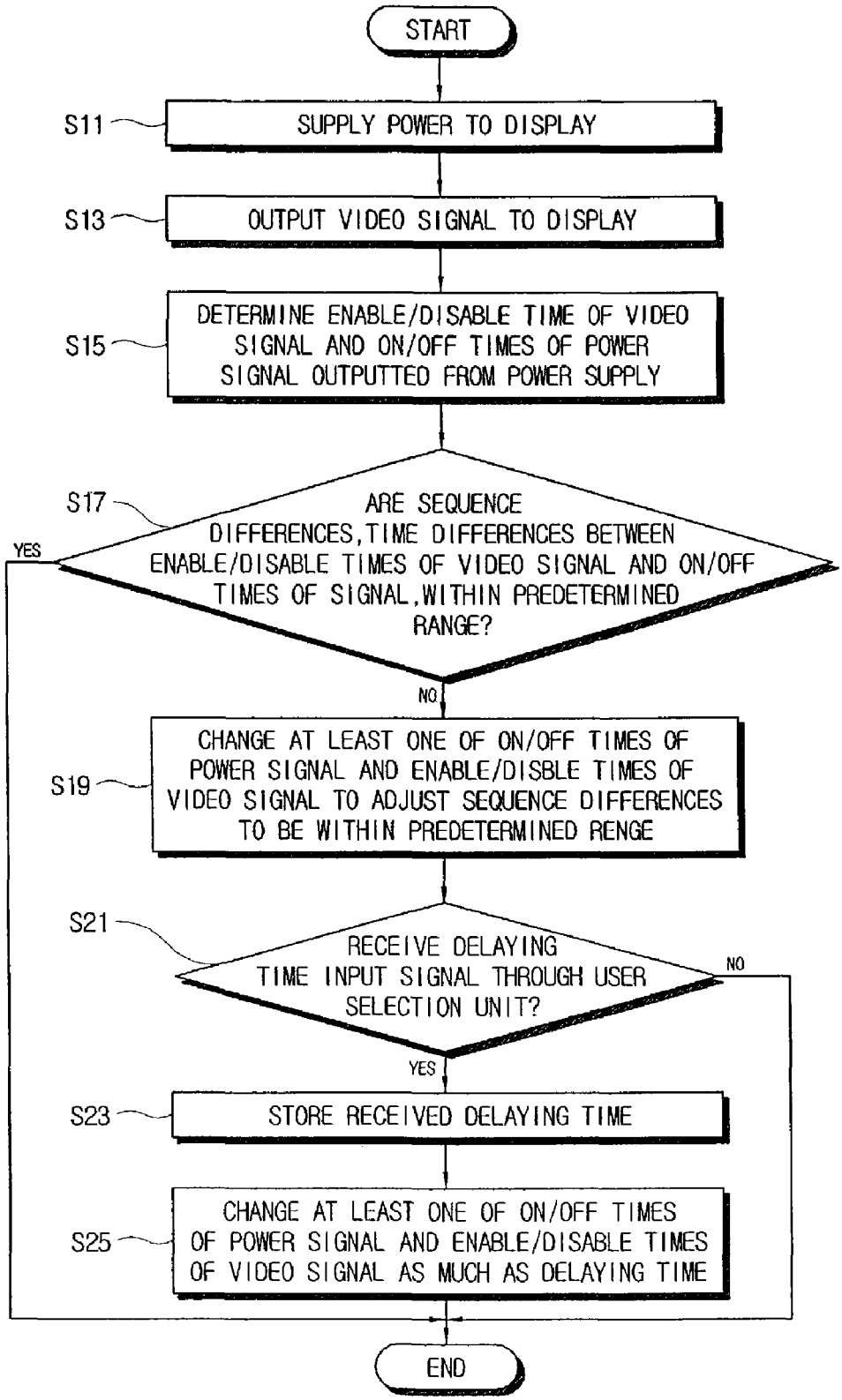
FIG. 3 is a control flowchart illustrating a method of a display apparatus according to an embodiment of the present general inventive concept.

FIG. 3 is a control flowchart illustrating the display apparatus according to an embodiment of the present general inventive concept. Referring to FIG. 3, the display apparatus outputs the power signal to the display 30 to turn on/off the display 30 at operation S11. At operation S13, the video signal is output to the display 30. At operation S15, the controller 50 determines the enable/disable times of the video signal and the on/off times of the power signal output from the power supply 70. Based on the enable/disable times of the video signal and the on/off times of the power signal, the controller 50 determines whether the sequence differences, time differences between the enable/disable times of the video signal and the on/off times of the power signal, are within the predetermined range at operation S17). When the sequence differences are out of the predetermined range, the controller 50 controls at least one of the power on/off signal and the video signal enable/disable signal, so that the sequence differences become within the predetermined range.

The controller 50 delays the enable time of the video signal to adjust the first sequence difference, the time difference between the on time of the power signal and the enable time of the video signal, and delays the off time of the power signal to adjust the second sequence difference, the time difference between the off time of the power signal and the disable time of the video signal.

Meanwhile, in the case that the controller 50 receives the predetermined delaying time input signal through the user selection unit 40 at operation S21, the controller 50 stores the received delaying time in the delaying time store unit 60 at operation S23 and changes the sequence differences according to the time period corresponding to the delaying time (Operation S25). The controller 50 may delay at least one of the on/off times and the enable/disable times by the delaying time.

As described above, the present general inventive concept provides a display apparatus and a control method thereof, in which a sequence difference, i.e., a time difference between an enable/disable time for a video signal to be applied to a display and an on/off time for a power signal to be applied to the display is adjusted to be within a predetermined range.

Thus, the present general inventive concept prevents malfunctions such as screen noise, overvoltage generation and etc., generated when the sequence differences are out of the predetermined range.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A display apparatus comprising a display, comprising:

a video processor to output a video signal to the display;

a power supply to output a power signal to turn on/off the display; and a controller to determine a sequence difference between an enable/disable time of the video signal output from the video processor and an on/off time of the power signal output from the power supply and, if the sequence difference is not a constant predetermined value, to selectively control the power supply and the video processor to make the sequence difference be the constant predetermined value.

2. The display apparatus according to claim 1, wherein the controller changes at least one of the on/off time of the power signal and the enable/disable time of the video signal when the sequence difference is not the constant predetermined value.

3. The display apparatus according to claim 2, wherein:

the enable/disable time of the video signal comprises at least one of an enable time of the video signal when the video signal starts to be displayed on the display and a disable time of the video signal when the video signal finishes being displayed on the display; and the on/off time of the power signal comprises at least one of an on time when an electric power starts to be supplied to the display and an off time when the electric power is blocked to the display.

4. The display apparatus according to claim 3, wherein the controller delays the enable time of the video signal to adjust the sequence difference between the on time of the power signal and the enable time of the video signal, and delays the off time of the power signal to adjust the sequence difference between the off time of the power signal and the disable time of the video signal.

5. The display apparatus according to claim 3, wherein the controller applies a power control signal having an initial on/off time to the power supply so as to control the on/off time of the power signal, determines a delayed time based on a time difference between the on/off time and the initial on/off time, and determines whether the sequence difference is not the constant predetermined value according to whether the delayed time is not a preset value.

6. The display apparatus according to claim 5, wherein the controller outputs the power control signal having a changed initial on/off time to the power supply so as to control the on/off time of the power signal.

7. The display apparatus according to claim 3, further comprising:

a user selection unit, wherein when a delaying time to delay the on/off time of the power signal is input through the user selection unit, the controller delays at least one of the on/off time of the power signal and the enable/disable time of the video signal according to the delaying time.

8. The display apparatus according to claim 7, further comprising:

a delaying time store unit to store the delaying time, wherein the controller delays the on/off time of the power signal and the enable/disable time of the video signal according to a period corresponding to the delaying time stored in the delaying time store unit.

9. A control method of a display apparatus having a display, the control method comprising:

outputting a power signal to turn on/off the display;

outputting a video signal to the display;

determining whether a sequence difference between an enable/disable time of the video signal and an on/off time of the power signal is within a predetermined range; and if the sequence difference is not within the predetermined range, selectively controlling the on/off time of the power signal and the enable/disable time of the video signal to make the sequence difference be a constant predetermined value.

10. The control method of the display apparatus according to claim 9, wherein:

the enable/disable time of the video signal comprises at least one of an enable time of the video signal when the video signal starts to be displayed on the display and a disable time of the video signal when the video signal finishes being displayed on the display; and the on/off time of the power signal comprises at least one of an on time when an electric power starts to be supplied to the display and an off time when the electric power is blocked to the display.

11. The control method of the display apparatus according to claim 10, further comprising:

receiving a delaying time input signal to delay the on/off time of the power signal; and delaying at least one of the on/off time and the enable/disable time as according to a delaying time.

12. The control method of the display apparatus according to claim 11, wherein the delaying of the on/off time according to a time period corresponding to the delaying time comprises storing the delaying time, and delaying at least one of the on/off time and the enable/disable time as much as the stored delaying time.

13. The control method of the display apparatus according to claim 9, wherein the selectively controlling of the sequence difference to make the sequence difference be the constant predetermined value comprises delaying the enable time of the video signal to adjust the sequence difference between the on time of the power signal and the enable time of the video signal, and delaying the off time of the power signal to adjust the sequence difference between the off time of the power signal and the disable time of the video signal.

14. The control method of the display apparatus according to claim 9, the determining of the sequence difference to be within the predetermined range comprising:

applying a power control signal having an initial on/off time to a power supply so as to control the on/off time of the power signal;

determining a delayed time based on a time difference between the on/off time and the initial on/off time which are outputted from the power supply; and determining whether the sequence difference is out of the predetermined range according to a determination of whether the delayed time is out of a preset range.

15. The control method of the display apparatus according to claim 14, wherein the selectively controlling the sequence difference to make the sequence difference be the constant predetermined value comprises outputting the power control signal having a changed initial on/off time, and changing the on/off time of the power signal by the power control signal.

16. A display apparatus, comprising:

a video source to supply a video signal to a display unit;

a power source to provide a power signal to the display unit; and a controller to determine a sequence difference between an enable time of the video signal supplied by the video source and an on time of the power signal provided by the power source and, if the sequence difference is not a constant predetermined time, to selectively control the video source and the power source to make the sequence difference the constant predetermined time.

17. The display apparatus of claim 16, wherein the controller controls at least one of a disable time of the video signal and an off time of the power signal so that the power signal ends within a second predetermined time after the video signal is stopped.

18. The display apparatus of claim 16, wherein the power source provides a feedback signal to the controller when the power supply starts supplying power to the display apparatus.

19. The display apparatus of claim 18, wherein the controller calculates a delaying time based on a difference between a time the feedback signal is received and a time the controller provides a power control signal to the power source to provide the power signal to the display unit.

20. The display apparatus of claim 19, wherein the controller controls the power source to provide a second power signal based on the delaying time so that the video signal is provided to the display unit within the predetermined time.

21. A display apparatus, comprising:

a display unit;

a video processor to provide a video signal to the display unit;

a power source to provide a power signal to the display unit; and a controller to determine a sequence difference between an enable and/or disable time of the video signal provided by the video processor and an on and/or off time of the power signal provided by the power source and, if the sequence difference is not a constant sequence difference, to selectively control the video processor and the power source to maintain the constant sequence difference.

22. The display apparatus of claim 21, wherein the controller controls the on and/or off times of the power signal with respect to the enable and/or disable times of the video signal.

23. The display apparatus of claim 22, wherein the controller controls the enable and/or disable times of the video signal with respect to the on and/or off times of the power signal.

24. A display apparatus, comprising:

a display unit;

a video process to provide a video signal to the display unit;

a power source to provide a power signal to the display unit; and a controller to determine a sequence difference between a time when the video processor starts to generate the video signal and a time when the power source starts to generate the power signal and, if the sequence difference is not a constant time difference, to selectively control the video processor and the power source to make the sequence difference the constant time difference.

25. A method of a display apparatus, the method comprising:

supplying a video signal to a display apparatus;

providing a power signal to the display apparatus;

determining a sequence difference between when the video signal is supplied to the display apparatus and when the power signal is provided to the display apparatus; and if the sequence difference is not a constant predetermined time selectively controlling an enable time of the video signal and an on time of the power signal to make the sequence difference the constant predetermined time.

26. A display apparatus comprising a display, comprising:

a video processor to output a video signal to the display;

a power supply to output a power signal to turn on/off the display; and a controller to determine a sequence difference between an enable/disable time of the video signal output from the video processor and an on/off time of the power signal output from the power supply and, if the sequence difference is not within a predetermined range, to selectively control at least one of the power supply and the video processor to make the sequence difference be within the predetermined range.

* * * * *